United States Patent [19]

Mehta et al.

[11] 4,127,237

[45] Nov. 28, 1978

[54] PLURAL BOWL MILLS IN SERIES

[75] Inventors: Arun K. Mehta, Bloomfield; Donald A. Smith, Haddam, both of Conn.

[73] Assignee: Combustion Engineering, Inc., Windsor, Conn.

[21] Appl. No.: 864,183

[22] Filed: Dec. 27, 1977

[51] Int. Cl.[2] ..... B02C 23/12

[52] U.S. Cl. ..... 241/58; 241/79; 241/117; 241/121

[58] Field of Search ..... 241/52, 58, 76, 78, 241/79, 80, 105, 115, 116, 117, 119, 121, 122

[56] References Cited

U.S. PATENT DOCUMENTS

| | | | |
|---|---|---|---|
| 2,012,266 | 8/1935 | Bailey et al. | 241/58 |
| 2,214,832 | 9/1940 | Hobbs | 241/58 |
| 2,698,142 | 12/1954 | Crites et al. | 241/121 |

*Primary Examiner*—Granville Y. Custer, Jr.
*Attorney, Agent, or Firm*—Robert L. Olson

[57] ABSTRACT

A bowl mill for pulverizing coal, wherein two bowl surfaces are rotated on the same shaft. The raw crushed coal is pulverized in one of the bowls, and the pulverized coal therefrom is then transported in an air stream to a classifier from where the fines are carried on to the ultimate point of use, and the more coarse particles are discharged into the second bowl for further grinding.

4 Claims, 3 Drawing Figures

PLURAL BOWL MILLS IN SERIES

BACKGROUND OF THE INVENTION

One present day method of pulverizing coal to be burned in a steam generator is to introduce raw crushed coal into a rotating bowl. The coal moves outwardly in the bowl by centrifugal action, coming within the gap between the bowl and its associated crushing rolls. The pulverized coal is flung off the edge of the bowl and is picked up and carried by an air stream to a classifier. Pyrites, tramp iron, and other impurities too heavy to be picked up by the air stream, fall to the mill bottom. The fines, 200 mesh and smaller, flow from the classifier to a steam generator (not shown) to be burned. The more coarse particles of coal are separated out of the air stream in the classifier, and are returned to the bowl mill for further pulverization. It is estimated that about 75% of the coal flowing to the classifier is recycled back to the bowl mill for further grinding.

One of the reasons for this high percentage of coal recycled back to the bowl mill for further grinding is that the coarse particles coming from the classifier pass through the gap between the bowl and roll without receiving sufficient grinding. This is because the relatively larger particles of raw coal and tramp iron tend to lift the roll away from the surface of the bowl as they pass therebetween. Thus the smaller recycled particles receive little additional grinding action, or they receive grinding action consisting of coal-to-coal contact, rather than coal-to-metal contact (being in actual contact with either the surface of the bowl, the roll, or both).

SUMMARY OF THE INVENTION

The pulverizing mill of the invention consists of a pair of bowl surfaces rotated on the same shaft. The raw crushed coal is pulverized on one of the bowl surfaces and then transported in an air stream to a classifier, with the fines carried on to a steam generator. The coarse coal particles are gravity fed onto the second bowl surface for further grinding.

DESCRIPTION OF THE PREFERRED EMBODIMENT

Figure 1:
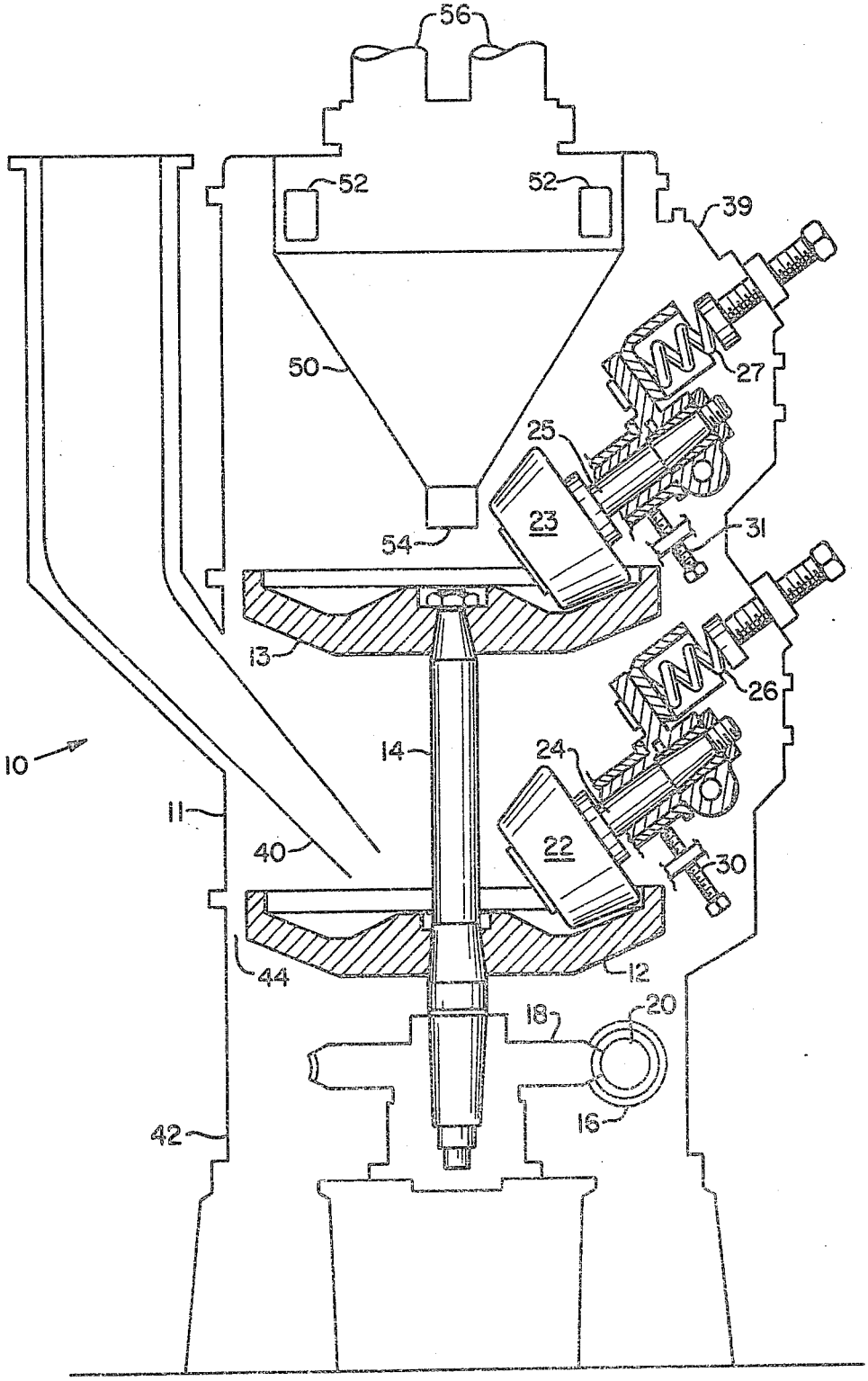
FIG. 1 is a cross-sectional side view of a bowl mill embodying the invention.

Looking now to FIG. 1, numeral 10 designates a pulverizing mill for grinding coal. Inside of a housing 11 is positioned two rotatable bowls 12 and 13, mounted on shaft 14. Shaft 14 along with the attached bowls are rotated by means of worm wheel 18, which engages worm 16 mounted on motor driven shaft 20.

Grinding elements or rolls 22 are rotatably mounted on shafts 24. Likewise rolls 23 are rotatably mounted on shafts 25. There are generally three rolls associated with each bowl, and they are equidistantly spaced around the periphery of the bowl. Adjustable springs 26 and 27 urge the rolls 22 and 23 towards their respective bowls. Adjustable stops 30 and 31 prevent actual metal-to-metal contact of the rolls and bowls, which contact could damage the apparatus.

Raw crushed coal is introduced into the lower bowl 12 through chute 40. Air enters through opening 42, and flows through annular space 44 to convey the ground material passing over the lip upwardly through the mill interior and into the classifier 50. The air and coal enter the classifier by way of inlets 52. The larger, or more coarse particles of partially ground coal fall onto the bowl 13 through bottom opening 54 for further grinding, and the finer particles are carried along by the air and are discharged through outlets 56.

The coarse particles of partially ground coal are further pulverized by the rolls 23 and the pulverized material is again picked up by the air stream and carried to the classifier 50. Since the particle size of the coal on bowl 13 is much smaller than those being ground on bowl 12, the stops for rolls 23 are set so as to maintain a smaller gap between bowl 13 and rolls 23, than is the case with bowl 12 and its associated rolls 22.

The operation of the mill described above is as follows. Raw crushed coal is introduced onto the bowl surface 12 for initial grinding. The ground coal is flung off the bowl and picked up in the air stream. Tramp iron and other heavy foreign objects too heavy to be carried in the air stram fall to the mill bottom. The fines are carried along through and exiting from the classifier through exits 56. The more coarse particles of coal are gravity fed to the bowl 13 for further grinding. The pulverized material flung off bowl 13 is again carried to the classifier 50.

Figure 2:
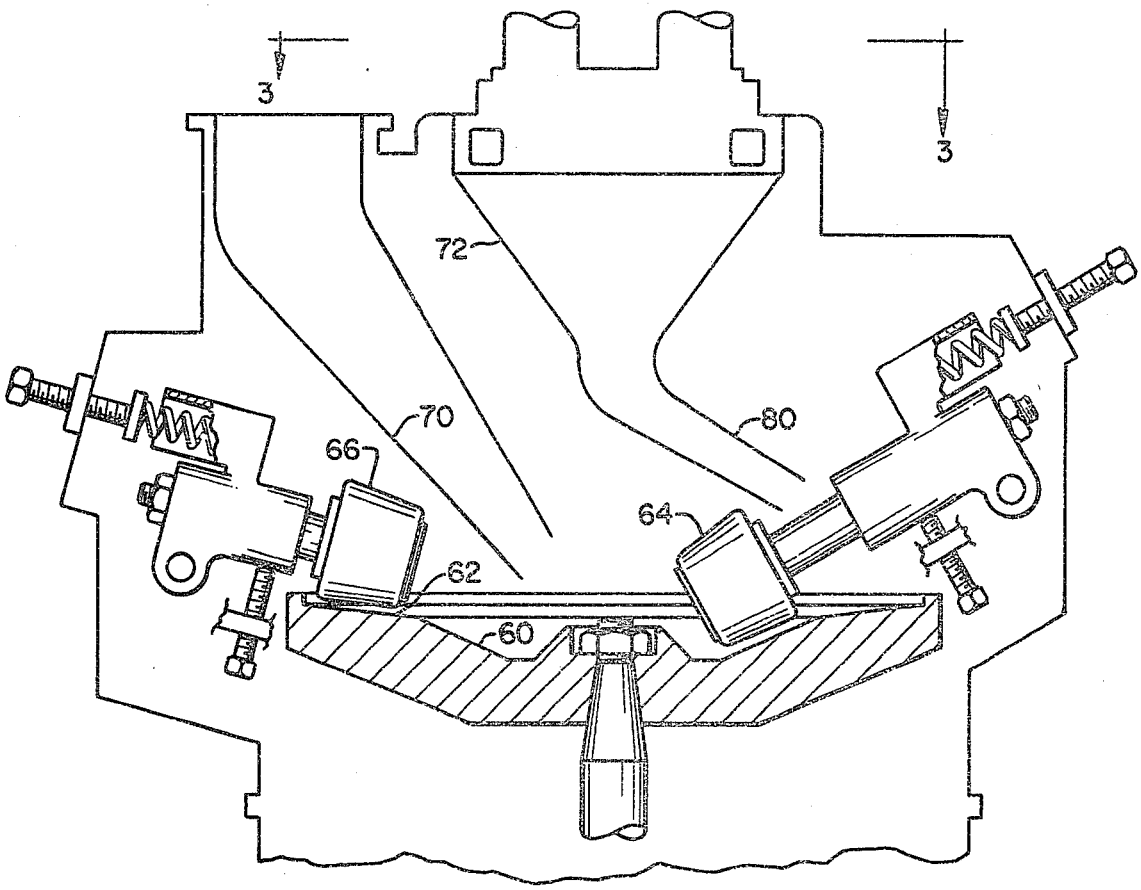
FIG. 2 is a cross-sectional side view of an alternative embodiment of the invention.
Figure 3:
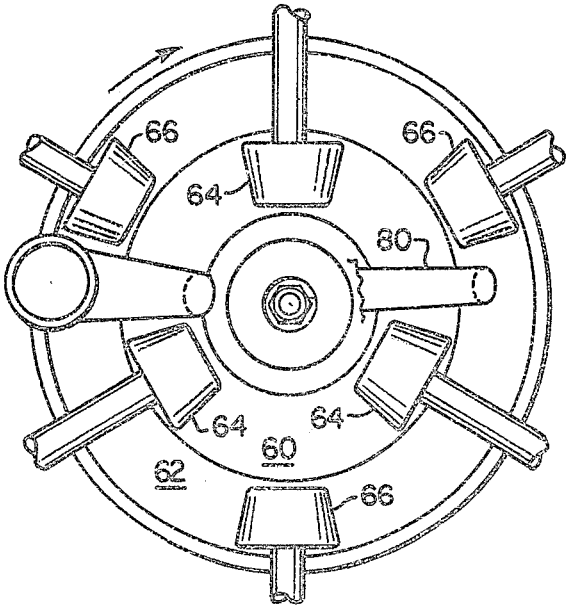
FIG. 3 is a view taken on line 3—3 of FIG. 2.

FIGS. 2 and 3 show an alternative arrangement incorporating the invention. Rather than two vertically spaced bowl surfaces as in FIG. 1, there are two concentric bowl surfaces 60 and 62. The rolls 64 and 66 cooperate with the surfaces 60 and 62 to accomplish the grinding. The raw crushed coal introduced through chute 70 is first ground by rolls 64, and the rolls 66, before being carried in an air stream to classifier 72. The coarse particles of coal separated out in the classifier 72 are gravity discharged onto the outer bowl surface 62 through chute 80 for further pulverization. As in the FIG. 1 embodiment, the gap between the inner bowl surface and its associated rolls is larger than the gap between the outer bowl surface and its associated rolls.

The above arrangements reduce the power requirements of the mill by reducing the amount of coal recirculating back for further reduction in size. Also, by mounting two bowl surfaces on one drive shaft, there is a power saving, a saving of capital cost, and a saving of space requirements.

What is claimed is:

1. In a grinding mill, a first bowl surface, means for rotating said first bowl surface, a first grinding roll positioned in a manner to co-act with the first bowl surface to accomplish grinding, means for maintaining the first roll a predetermined distance from the first bowl surface, means for introducing material to be ground onto the first bowl surface, a classifier to which the ground material leaving the first bowl surface is conveyed, a second bowl surface, means for rotating said second bowl surface, a second grinding roll positioned in a manner to co-act with the second bowl surface to accomplish grinding, means for maintaining the second roll a predetermined distance from the second bowl surface, which distance is less than the distance between the first roll and first bowl surface, and means for discharging the coarse particles separated out in the classifier onto the second bowl surface.

2. The grinding mill set forth in claim 1, wherein the first and second bowl surfaces are mounted on the same shaft.

3. The grinding mill set forth in claim 2 wherein the first bowl surface is mounted on the shaft vertically below the second bowl surface.

4. The grinding mill set forth in claim 2, wherein the second bowl surface is basically concentric with and surrounding the first bowl surface.

* * * * *